US008491324B1

(12) United States Patent
Yang et al.

(10) Patent No.: US 8,491,324 B1
(45) Date of Patent: Jul. 23, 2013

(54) LAMP HOLDER CONNECTOR

(75) Inventors: Mei-Chuan Yang, Taoyuan (TW); Chin-Te Chiu, Taoyuan (TW)

(73) Assignee: Proconn Technology Co., Ltd., Taoyuan County (TW)

( * ) Notice: Subject to any disclaimer, the term of this patent is extended or adjusted under 35 U.S.C. 154(b) by 62 days.

(21) Appl. No.: 13/345,661

(22) Filed: Jan. 6, 2012

(51) Int. Cl.
*H01R 33/08* (2006.01)

(52) U.S. Cl.
USPC ..... 439/226; 439/239

(58) Field of Classification Search
USPC ..... 439/226, 239, 372
See application file for complete search history.

(56) References Cited

U.S. PATENT DOCUMENTS

| | | | | |
|---|---|---|---|---|
| 2,945,202 | A * | 7/1960 | Roney et al. | 439/232 |
| 6,325,651 | B1 * | 12/2001 | Nishihara et al. | 439/232 |
| 8,282,408 | B1 * | 10/2012 | Chou et al. | 439/226 |
| 2009/0068869 | A1 * | 3/2009 | Brand et al. | 439/226 |

* cited by examiner

*Primary Examiner* — Gary F. Paumen

(57) ABSTRACT

A lamp holder connector adapted for connecting with a lamp includes a first holder, a second holder, a connecting part, at least two buckling ears, a first terminal assembled in the first holder and a second terminal assembled in the second holder to electrically connect with the first terminal. Two opposite sides of the first holder defines two restraining arms. The second holder defines an accommodating chamber for receiving the connecting part therein. The connecting part defines an accommodating space for receiving the first holder therein. The two buckling ears are pivotally fastened to two sides of the connecting part. Two tops of the two buckling ears are matched with the restraining arms. Each buckling ear has at least one propping portion projecting into the accommodating space to prop up the first holder under rotating actions of the buckling ears when the lamp holder connector is disassembled.

10 Claims, 7 Drawing Sheets

LAMP HOLDER CONNECTOR

BACKGROUND OF THE INVENTION

1. Field of the Invention

The present invention generally relates to a lamp holder connector, and more particularly to a lamp holder connector capable of improving working performance.

2. The Related Art

Generally, a conventional lamp holder connector includes a first holder, a second holder, a first terminal received in the first holder, and a second terminal received in the second holder. When the first holder together with the first terminal is mounted to the second holder with the second terminal assembled therein, the first terminal contacts with the second terminal to realize an electrical connection between the first terminal and the second terminal. However, the first terminal and the second terminal are inserted into the first holder and the second holder directly without any fastening elements used to fasten the first terminal and the second terminal in the first holder and the second holder that often results in a tilted insertion of the first terminal and the second terminal in the first holder and the second holder. Furthermore, the first terminal and the second terminal are apt to deviate from original positions in the first holder and the second holder when the lamp holder connector is shaken.

SUMMARY OF THE INVENTION

An object of the present invention is to provide a lamp holder connector adapted for connecting with a lamp. The lamp holder connector includes a first holder, a second holder, a connecting part, at least two buckling ears, a first terminal and a second terminal. The first holder includes a cover and a base. The cover is covered on the base to define a receiving space therebetween for receiving the lamp therein. Two opposite sides of the first holder defines two restraining arms. The second holder is with an accommodating chamber being defined therein. The connecting part connects between the first holder and the second holder. The connecting part is mounted in the accommodating chamber and defines an accommodating space for receiving the first holder therein. The two buckling ears are pivotally fastened to two sides of the connecting part. Two tops of the two buckling ears are matched with the two restraining arms of the first holder. Each buckling ear has at least one propping portion protruded at a bottom thereof and projecting into the accommodating space to prop up the first holder under rotating actions of the buckling ears when the lamp holder connector is disassembled. The first terminal is assembled in the first holder with a top thereof projecting into the receiving space to electrically connect with the lamp and a bottom thereof passing through the first holder and the connecting part to project into the accommodating chamber of the second holder. The second terminal is assembled in the accommodating chamber of the second holder to electrically contact with the bottom of the first terminal.

As described above, the connecting part with the buckling ears being pivotally fastened thereto is connected between the first holder and the second holder with the two buckling ears being matched with the two restraining arms of the first holder, the first terminal being assembled in the first holder and the second terminal being assembled in the second holder to make the first terminal and the second terminal assembled in the first holder and the second holder exactly and steadily. Furthermore, the propping portions project into the accommodating space to prop up the first holder together with the first terminal and the lamp under rotating actions of the buckling ears when the lamp holder connector is disassembled. Thus, working performance of the lamp holder connector is assured.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
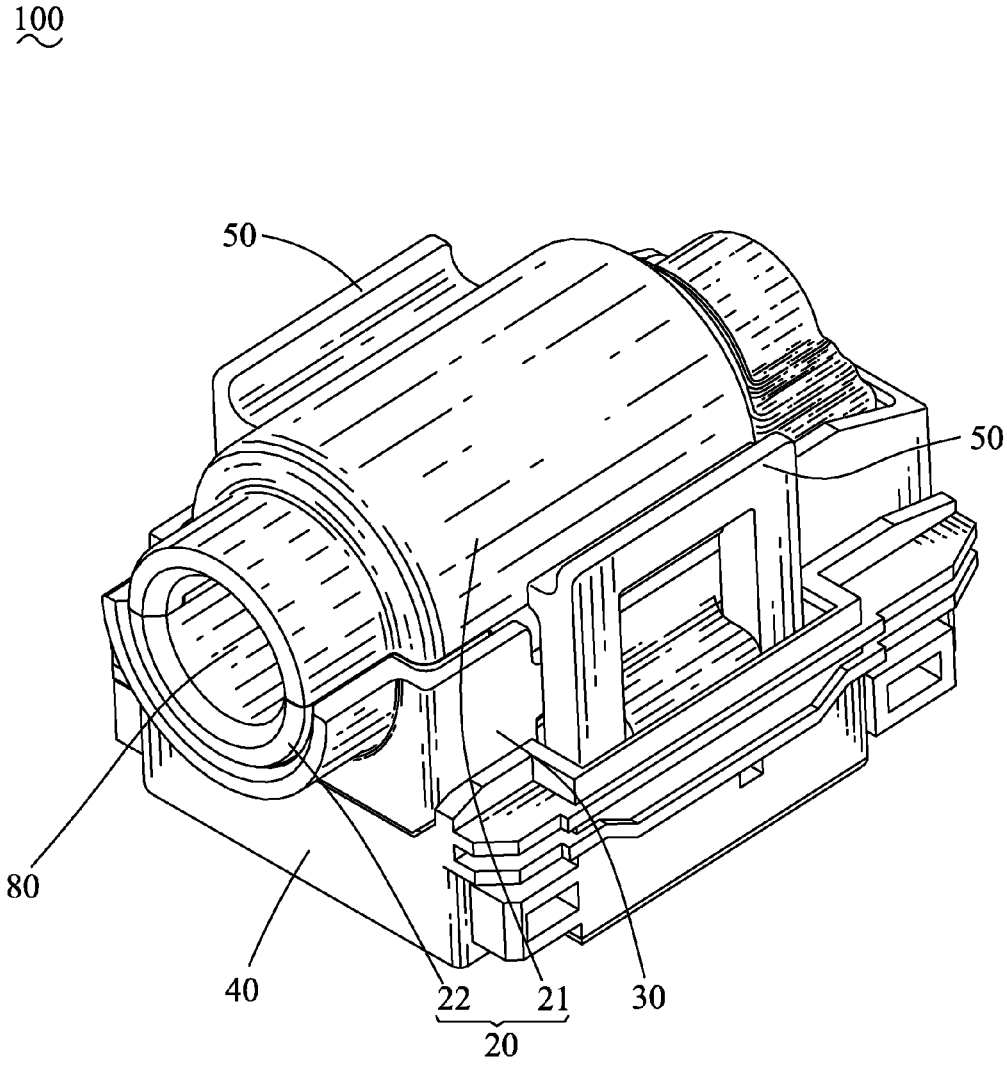
FIG. 1 is a perspective view of a lamp holder connector in accordance with the present invention.

With reference to FIG. 1, FIG. 2, FIG. 9 and FIG. 10, a lamp holder connector 100 in accordance with the present invention is shown. The lamp holder connector 100 adapted for connecting with a lamp 10 includes a first holder 20, a second holder 40, a connecting part 30 connecting between the first holder 20 and the second holder 40, a pair of buckling ears 50, a first terminal 60 assembled in the first holder 20, and a second terminal 70 assembled in the second holder 40.

Figure 2:
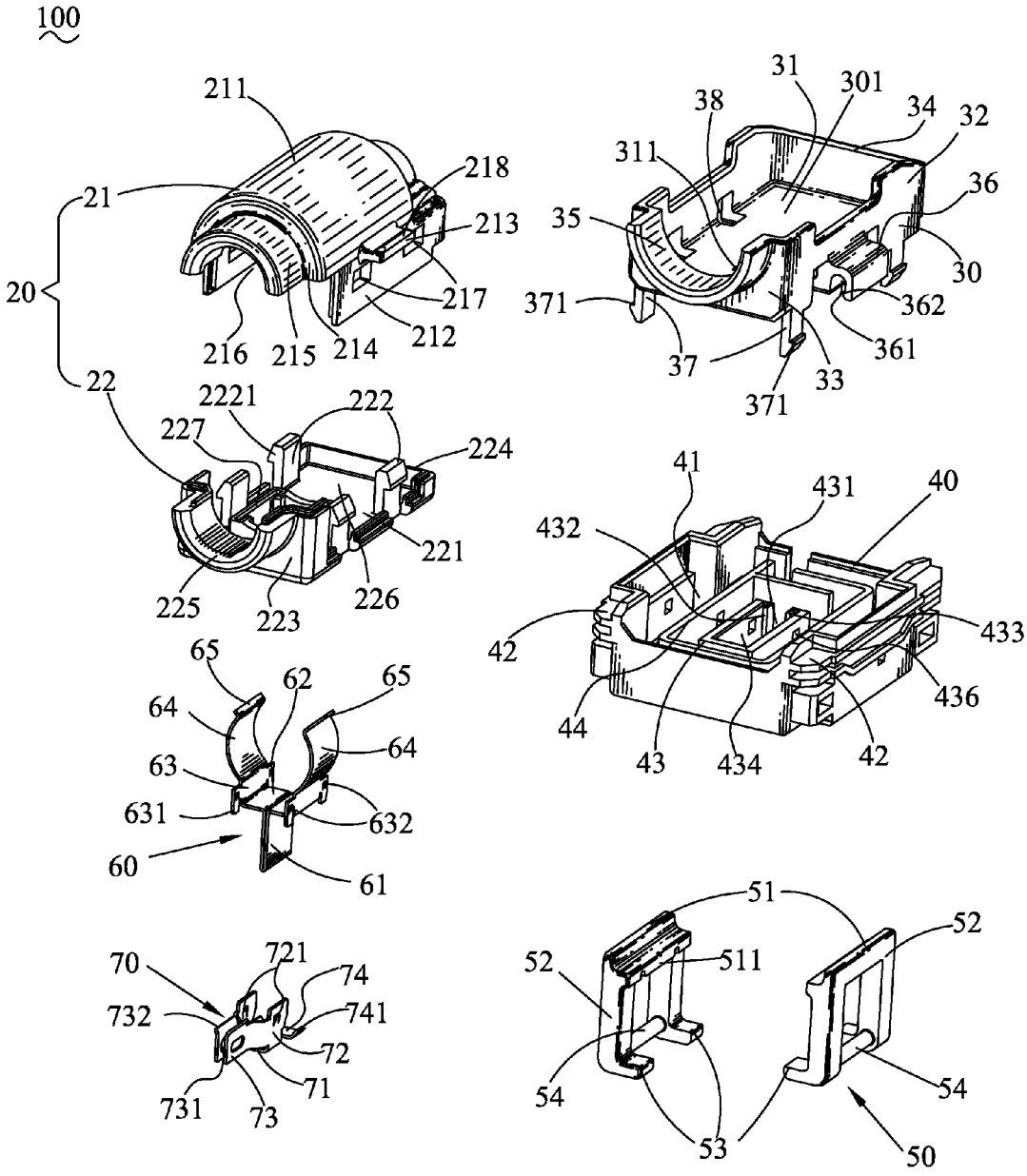
FIG. 2 is an exploded view of the lamp holder connector of FIG. 1.

Referring to FIG. 2, the first holder 20 includes a cover 21 and a base 22. The cover 21 has an arc-shaped main body 211 with an opening thereof facing downward. Two bottoms of two opposite sides of the main body 211 extend downward to form two first side walls 212. A front end of the main body 211 connects with a hemi-ring-shaped first front wall 214, and a rear end of the main body 211 connects with a first rear wall (not shown). An inner periphery of the ring-shaped first front wall 214 extends forward to form an arc-shaped first supporting wall 215. A first receiving space 216 is formed among the main body 211, the two first side walls 212, the first front wall 214, the first supporting wall 215 and the first rear wall. Each first side wall 212 defines two first buckling holes 217 spaced form each other. Outer surfaces of the two bottoms of the two opposite sides of the main body 211 protrude oppositely to form two restraining arms 213. Two outer sides of two tops of the two restraining arms 213 extend upward to form two blocking portions 218.

Figure 3:
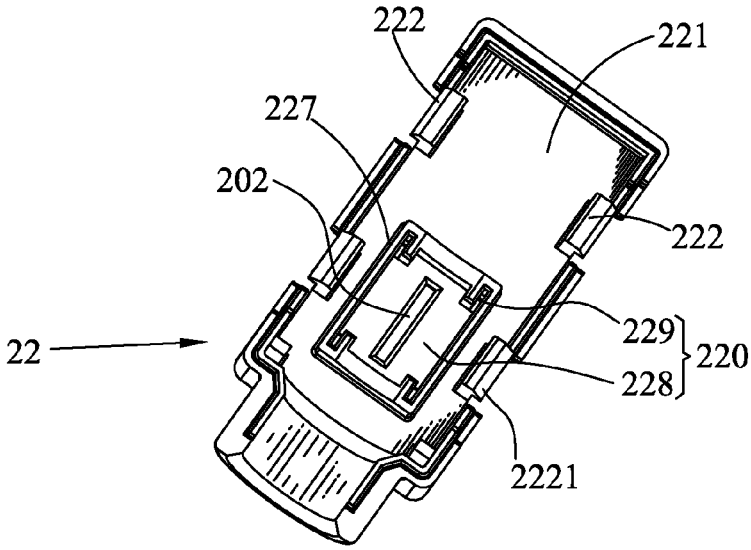
FIG. 3 is a perspective view of a base of the lamp holder connector of FIG. 2.

Referring to FIG. 2 and FIG. 3, the base 22 has a rectangular base board 221. Two portions of each side of the base board 221 protrude upward to form two locating portions 222. A top of an outer surface of the locating portion 222 protrudes outward to form a first buckling portion 2221. A front end of the base board 221 extends upward to form a second front wall 223 and a rear end of the base board 221 extends upward to form a second rear wall 224. A top of the second front wall 223 is concaved downward to define an arc-shaped groove (not shown). An inner periphery of the groove extends forward to form a second supporting wall 225. A second receiving space 226 is formed among the base board 221, the locating portions 222, the second front wall 223, the second rear wall 224 and the second supporting wall 225. A locating frame 227 is located on a top of the base board 221 with a locating groove 228 being formed therein. Two opposite ends of each side of the locating groove 228 extend oppositely to form two fillisters 229. The locating groove 228 and the four fillisters 229 together define a first terminal groove 220. The base board 221 defines an elongated insertion hole 202 surrounded by the locating frame 227 to communicate with the locating groove 228.

Referring to FIG. 1 and FIG. 2, the connecting part 30 has a rectangular bottom wall 31. Two opposite sides of the bottom wall 31 extend upward to form two lateral walls 32. A front end of the bottom wall 31 extends upward to form a front blocking wall 33. A rear end of the bottom wall 31 extends upward to form a rear blocking wall 34. A top of the front blocking wall 33 is concaved downward to define an arc-shaped mouth (not shown). An inner periphery of the mouth extends forward to form an arc-shaped propping wall 35. An accommodating space 301 is surrounded among the bottom wall 31, the two lateral walls 32, the front blocking wall 33, the rear blocking wall 34 and the propping wall 35. Two middles of the two lateral walls 32 extend outward, and then bend downward to form two second buckling portions 36. A pivoting groove 361 is formed between an outer side of the lateral wall 32 and the second buckling portion 36. A bottom of an inner side of the second buckling portion 36 defines a protrusion 362. Two ends of a bottom of the lateral wall 32 extend downward to form two fastening portions 37. A bottom of an outer side of the fastening portion 37 defines a barb 371. A middle of the bottom wall 31 defines an insertion slot 311. A junction of each lateral wall 32 and the bottom wall 31 defines two connecting grooves 38.

Figure 4:
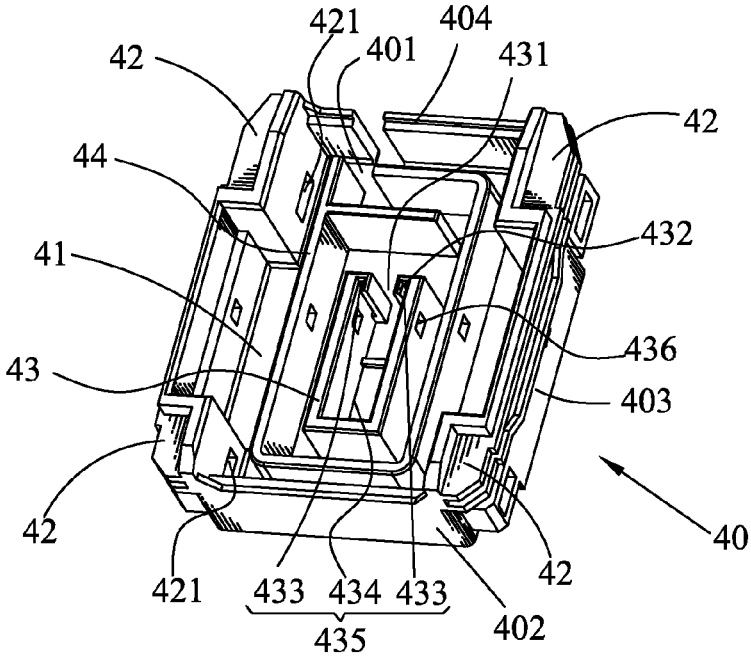
FIG. 4 is a perspective view of a second holder of the lamp holder connector of FIG. 2.

Referring to FIG. 2 and FIG. 4, the second holder 40 has a base wall 401 disposed horizontally. Two opposite ends of the base wall 401 extend upward to form a front end wall 402 and a rear end wall 404. Two opposite sides of the base wall 401 extend upward to form two second side walls 403. An accommodating chamber 41 is formed among the base wall 401, the two end walls 402 and the two second side walls 403. Four inner corners of the second holder 40 protrude inward to form four protruding blocks 42. An inner surface of each protruding block 42 defines a fastening groove 421. A rectangular first frame 43 is located on a top of the base wall 401. A middle of a rear of the first frame 43 defines a gap 431. Two inner sides of two sidewalls of the gap 431 extend forward to form two blocking arms 432. A clipping groove 433 is formed among the blocking arm 432, the corresponding sidewall of the gap 431 and a rear of a side of the first frame 43. A holding groove 434 is formed among a front of the first frame 43, and two fronts of the two sides of the first frame 43. The two clipping grooves 433 and the holding groove 434 together define a second terminal groove 435. Each side of the first frame 43 defines a second buckling hole 436. A second frame 44 is located on the top of the base wall 401 and surrounds the first frame 43. The second holder 40 defines a notch (not labeled) passing through the rear end wall 404 and a rear of the second frame 44.

Referring to FIG. 2, each of the buckling ears 50 has two fastening arms 52 disposed vertically. A connecting arm 51 is connected between two top ends of the two fastening arms 52. One side of the connecting arm 51 protrudes sideward to define a rib 511. A pivoting pillar 54 is connected between two bottoms of two inner sides of the two fastening arms 52. A bottom of the fastening arm 52 is bent towards a same direction as that of the rib 511 to define a propping portion 53.

Figure 5:
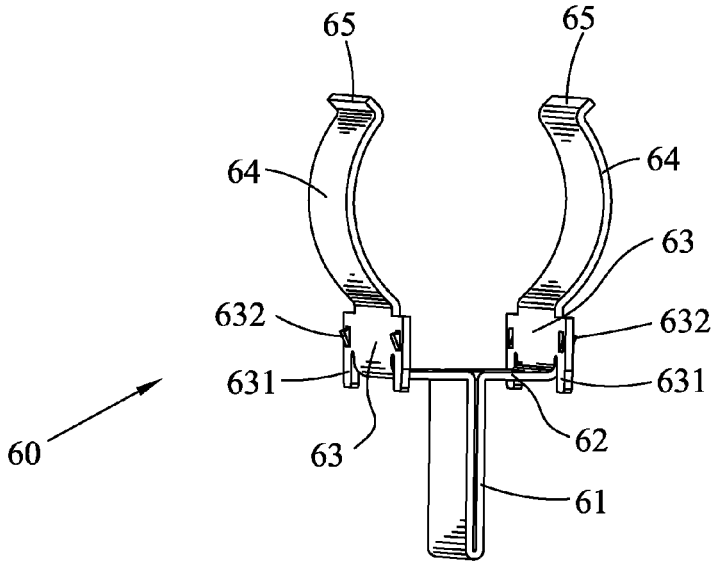
FIG. 5 is a perspective view of a first terminal of the lamp holder connector of FIG. 2.

Referring to FIG. 2 and FIG. 5, the first terminal 60 is of a symmetrical structure. The first terminal 60 has an insertion piece 61 folded up by a piece of metal. Two free ends of the first terminal 60 are bent oppositely to form two connecting pieces 62. Two free ends of the two connecting pieces 62 are bent upward to form two fastening pieces 63. Two opposite sides of the fastening piece 63 extend outward, and then extend downward to form two bars 631. The two bars 631 are punched outward to form two resisting portions 632. Two free ends of the fastening pieces 63 are arced outward to form two clamping pieces 64. A free end of the clamping piece 64 is obliquely bent outward to form a guiding piece 65.

Figure 6:
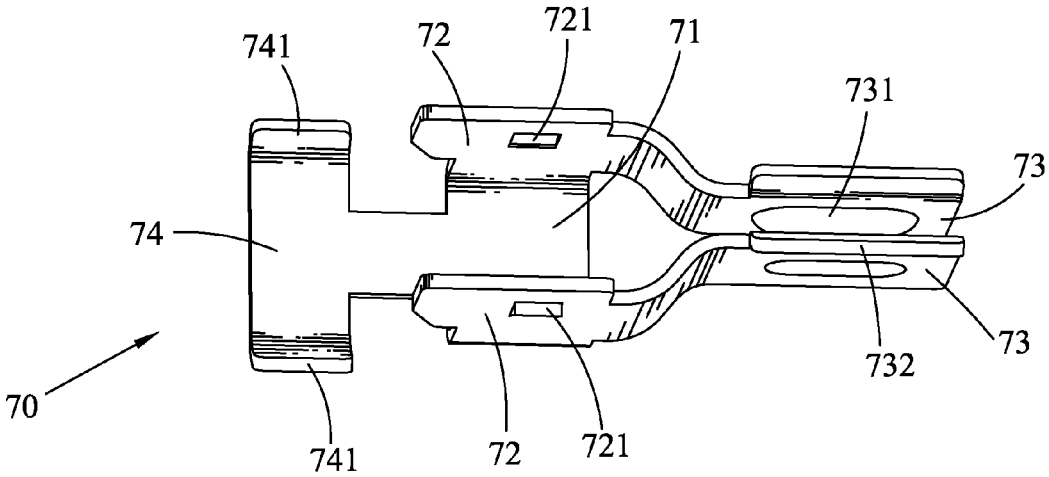
FIG. 6 is a perspective view of a second terminal of the lamp holder connector of FIG. 2.

Referring to FIG. 2 and FIG. 6, the second terminal 70 is also of a symmetrical structure. The second terminal 70 has a lying T-shaped base portion 71. Two opposite sides of the base portion 71 are bent upward to form two bending portions 72 with two buckling blocks 721 being punched outward. Two front ends of the two bending portions 72 are bent towards each other, and then extend forward to form two elastic portions 73. Two opposite sides of the two elastic portions 73 are concaved inward to define two convex portions 731 face to face. A rear end of the base portion 71 is connected with a middle of a supporting board 74. Two opposite ends of the supporting board 74 are bent upward to form two supporting portions 741. Two tops of the two elastic portions 73 are slightly inclined outward to form two guiding portions 732.

Referring to FIGS. 1-8, when the lamp holder connector 100 is assembled, the first terminal 60 is assembled to the first terminal groove 220 of the base 22 from a top to a bottom of the base 22. Specifically, the insertion piece 61 is inserted into the insertion hole 202 to project under the base 22. The two connecting pieces 62 and the two fastening pieces 63 are located in the locating groove 228 with the resisting portions 632 interfering with two opposite inner sides of the locating frame 227. The bars 631 are inserted into the fillisters 229. The clamping pieces 64 and the guiding pieces 65 are exposed out of the locating groove 228 to project above the locating frame 227. The lamp 10 is clamped between the two clamping pieces 64 through the guiding pieces 65 to locate the lamp 10 on the locating frame 227 and the second supporting wall 225 of the base 22. The cover 21 is covered on the lamp 10 and the base 22 with the first supporting wall 215 being engaged with the second supporting wall 225, the first rear wall being matched with the second rear wall 224, and the first buckling portions 2221 being buckled in the first buckling holes 217 to make the two first side walls 212 located on the two opposite sides of the base board 221 to integrate the first receiving space 216 and the second receiving space 226 together to define a receiving space 80 so as to restrain the lamp 10 in the receiving space 80 of the first holder 20 steadily.

Then, the second terminal 70 is assembled to the second terminal groove 435 of the second holder 40 from a top to a bottom of the second holder 40. Specifically, the base portion 71, two fronts of the two bending portions 72 and the two elastic portions 73 are located in the holding groove 434 with the buckling blocks 721 being buckled in the second buckling holes 436. Two rears of the two bending portions 72 are inserted into the clipping grooves 433. The supporting board 74 is located between the rear of the first frame 43 and an inside of the rear of the second frame 44. A cable 90 is located between an outer periphery of the first frame 43 and an inner periphery of the second frame 44 with one end of the cable 90 being soldered to the supporting board 74 and the other end of the cable 90 projecting out of the second holder 40 from the notch.

Next, the buckling ears 50 are assembled to the connecting part 30. The pivoting pillar 54 of the buckling ear 50 is pivotally fastened to the pivoting groove 361. And the protrusion 362 guides the pivoting pillar 54 slides into the pivoting groove 361 smoothly and blocks the pivoting pillar 54 from being falling off from the pivoting groove 361. The propping portions 53 project into the accommodating space 301 through the connecting grooves 38. The connecting part 30 together with the two buckling ears 50 is assembled to the second holder 40 with the barbs 371 being fastened in the fastening grooves 421. The insertion slot 311 is corresponding to an interval between the two elastic portions 73. The connecting arm 51 and the fastening arms 52 pivots the pivoting pillar 54 to rotate outward at an angle.

Referring to FIG. 7, FIG. 8, FIG. 9 and FIG. 10, at last, the connecting part 30 with the buckling ears 50 being pivotally fastened thereto is connected between the first holder 20 with the first terminal 60 and the lamp 10 being assembled therein, and the second holder 40 with the second terminal 70 being assembled therein. The base board 221 of the base 22 is positioned on the bottom wall 31 of the connecting part 30 to press the propping portions 53 downward so as to drive the buckling ears 50 to rotate inward to make the ribs 511 slide onto the restraining arms 213 until the ribs 511 are blocked by the blocking portions 218 so as to ensure the first holder 20 together with the first terminal 60 and the lamp 10 to integrate with the connecting part 30 tightly. The insertion piece 61 passes through the insertion slot 311 to insert into the interval between the two elastic portions 73 along the two guiding portions 732 to electrically connect with the two convex portions 731.

Figure 7:
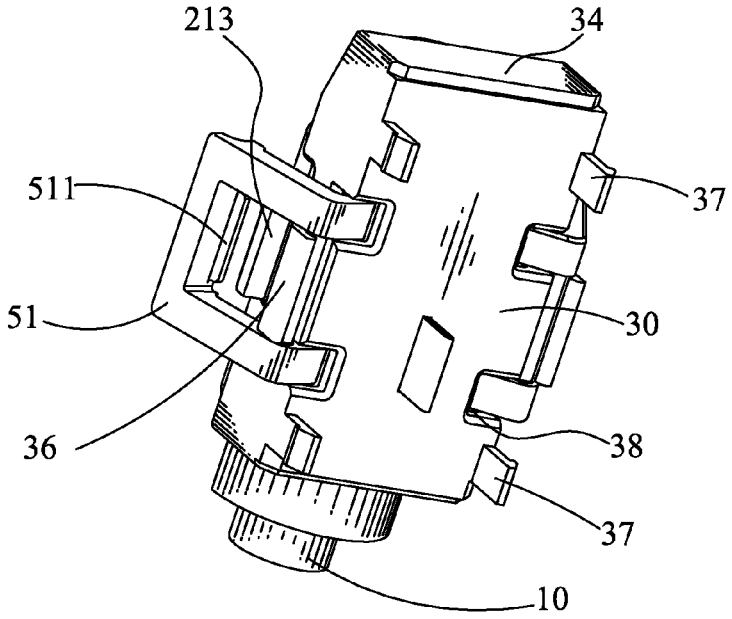
FIG. 7 is a partially perspective view of the lamp holder connector of FIG. 1, wherein a first holder of the lamp holder connector with a lamp being assembled therein is assembled in a connecting part of the lamp holder connector with two buckling ears of the lamp holder connector being pivotally fastened thereto.
Figure 8:
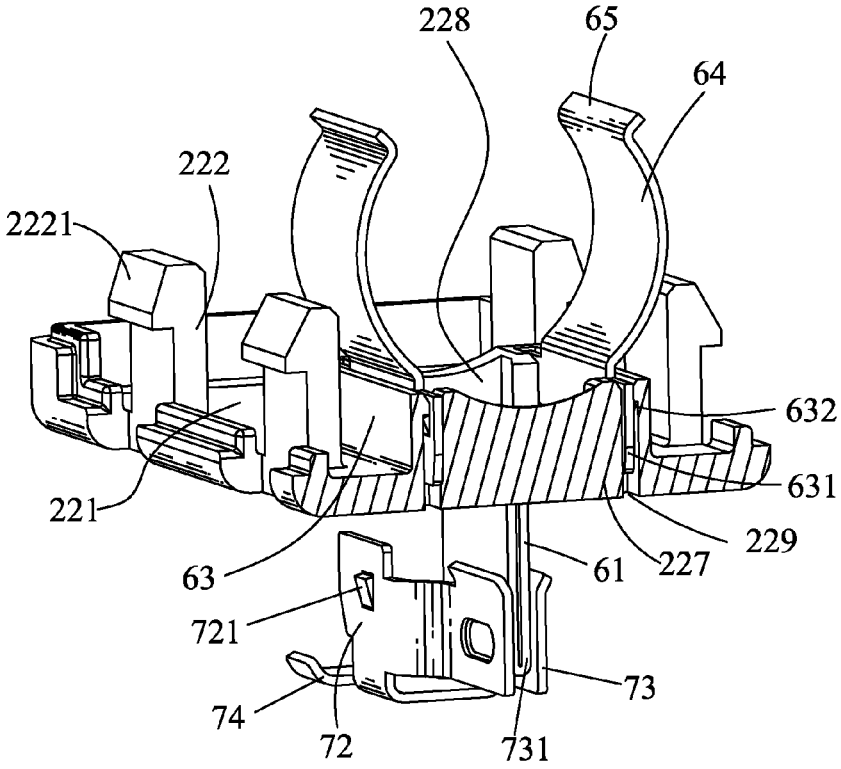
FIG. 8 is a partially sectional view of the lamp holder connector of FIG. 1, showing that the first terminal is assembled in the base of the first holder with a bottom thereof passing through the base to electrically connect with the second terminal.
Figure 9:
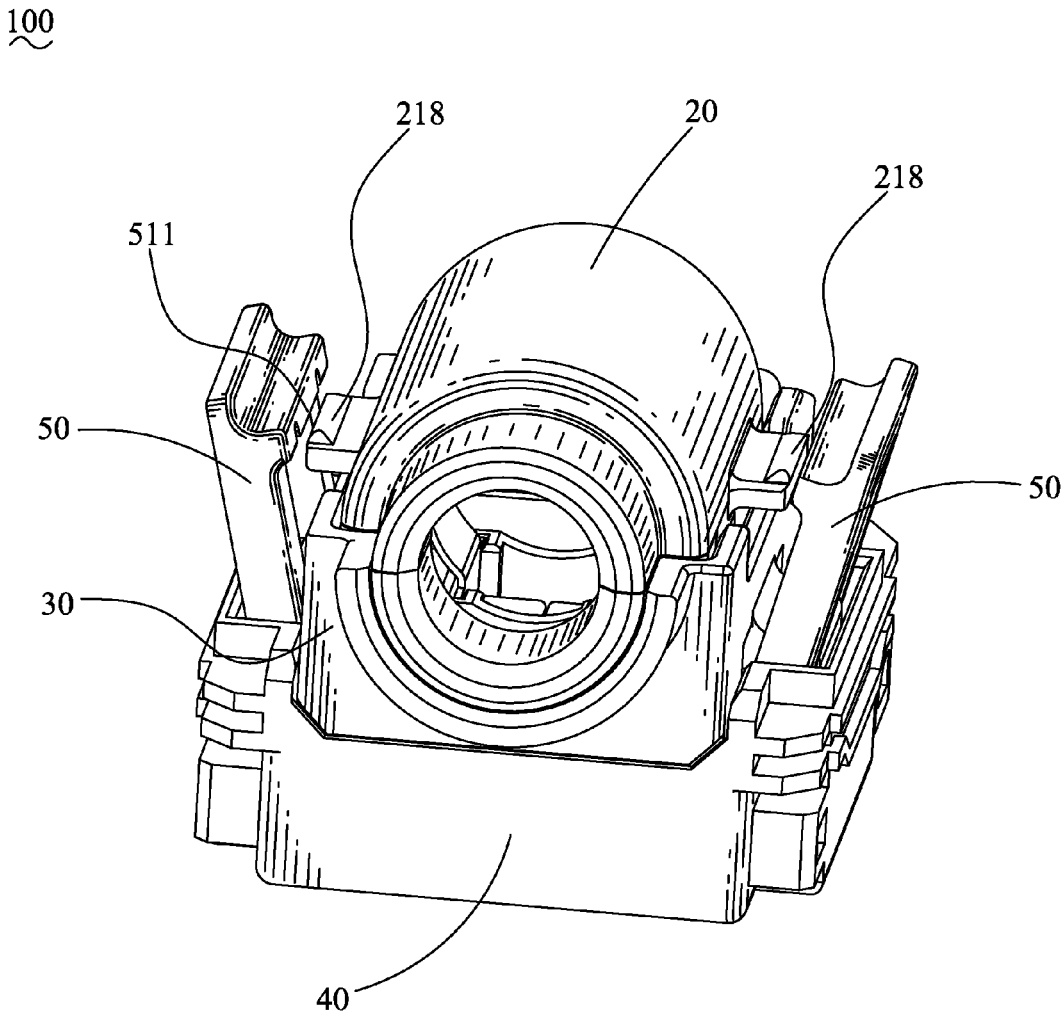
FIG. 9 is a perspective view of the lamp holder connector of FIG. 1, before two buckling ears are buckled.
Figure 10:
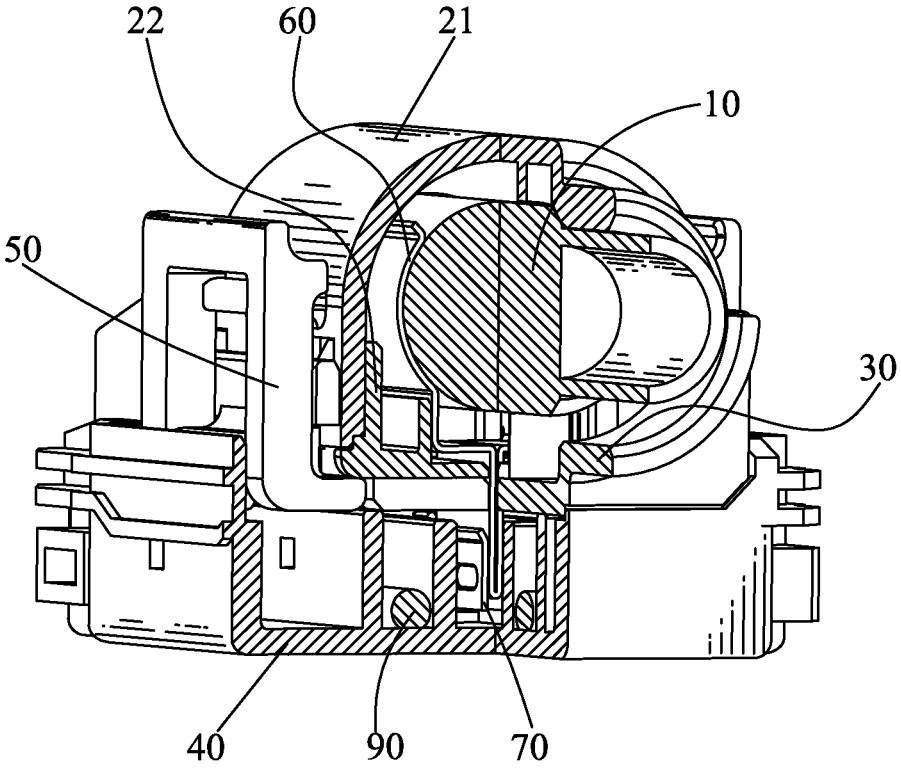
FIG. 10 is a partially sectional view of the lamp holder connector of FIG. 1.

Referring to FIG. 7 and FIG. 9, when the lamp holder connector 100 is disassembled to change the lamp 10, the connecting arms 51 are pulled outward to drive the buckling ears 50 to rotate outward to bring along the ribs 511 slide outward along the blocking portions 218 until the ribs 511 are completely apart from the restraining arms 213. At that case, the propping portions 53 is tilted upward to prop up the first holder 20 together with the first terminal 60 and the lamp 10. Then take out the first holder 20 together with the first terminal 60 and the lamp 10, and disassemble the first holder 20 to realize changing the lamp 10.

As described above, the connecting part 30 with the buckling ears 50 being pivotally fastened thereto is connected between the first holder 20 and the second holder 40 with the ribs 511 of the buckling ears 50 being blocked by the blocking portions 218 of the cover 21 of the first holder 20, the first terminal 60 being assembled in the first terminal groove 220 of the first holder 20 and the second terminal 70 being assembled in the second terminal groove 435 of the second holder 40 to make the first terminal 60 and the second terminal 70 assembled in the first holder 20 and the second holder 40 exactly and steadily. Furthermore, the propping portions 53 project into the accommodating space 301 through the connecting grooves 38 to prop up the first holder 20 together with the first terminal 60 and the lamp 10 under rotating actions of the buckling ears 50 when the lamp holder connector 100 is disassembled. Thus, working performance of the lamp holder connector 100 is assured.

What is claimed is:

1. A lamp holder connector adapted for connecting with a lamp, comprising:

a first holder including a cover and a base, the cover being covered on the base to define a receiving space there between for receiving the lamp therein, two opposite sides of the first holder defining two restraining arms;

a second holder with an accommodating chamber being defined therein;

a connecting part connecting between the first holder and the second holder, the connecting part being mounted in the accommodating chamber, and defining an accommodating space for receiving the first holder therein;

at least two buckling ears pivotally fastened to two sides of the connecting part, two tops of the two buckling ears being matched with the two restraining arms of the first holder, each buckling ear having at least one propping portion protruded at a bottom thereof and projecting into the accommodating space to prop up the first holder under rotating actions of the buckling ears when the lamp holder connector is disassembled;

a first terminal assembled in the first holder with a top thereof projecting into the receiving space to electrically connect with the lamp and a bottom thereof passing through the first holder and the connecting part to project into the accommodating chamber of the second holder; and a second terminal assembled in the accommodating chamber of the second holder to electrically contact with the bottom of the first terminal.

2. The lamp holder connector as claimed in claim 1, wherein the two sides of the connecting part extend outward, and then bend downward to form two second buckling portions, a pivoting groove is formed between the side of the connecting part and the second buckling portion, a bottom of an inner side of the second buckling portion defines a protrusion, a junction of each side and a bottom of the connecting part defines two connecting grooves, each of the buckling ears has two fastening arms, a pivoting pillar is connected between two bottoms of the two fastening arms, a bottom of the fastening arm bends sideward to define the propping portion, the pivoting pillar is pivotally fastened to the pivoting groove, the protrusion blocks the pivoting pillar from being falling off from the pivoting groove, the propping portions project into the accommodating space through the connecting grooves.

3. The lamp holder connector as claimed in claim 2, wherein two opposite sides of the cover protrude oppositely to form the two restraining arms, two outer sides of two tops of the two restraining arms extend upward to form two blocking portions, a connecting arm is connected between two top ends of the two fastening arms, one side of the connecting arm protrudes sideward to define a rib, the base is positioned in the accommodating space of the connecting part to press the propping portions downward so as to drive the buckling ears to rotate inward to make the ribs slide onto the restraining arms until the ribs are blocked by the blocking portions.

4. The lamp holder connector as claimed in claim 3, wherein the two opposite sides of the cover defines a plurality of first buckling holes located under the two restraining arms, each side of the base defines a plurality of locating portions, an outer surface of a top of the locating portion protrudes outward to form a first buckling portion buckled in the corresponding first buckling hole.

5. The lamp holder connector as claimed in claim 1, wherein each inner corner of the second holder protrudes inward to form a protruding block, an inner surface of each protruding block defines a fastening groove, each end of a bottom of each side of the connecting part extends downward to form a fastening portion, a bottom of an outer side of the fastening portion defines a barb fastened in the fastening groove.

6. The lamp holder connector as claimed in claim 1, wherein the base has a base board, a locating frame is located on a top of the base board with a locating groove being formed therein, two opposite ends of each side of the locating groove extend oppositely to form two fillisters, the base board defines an insertion hole communicating with the locating groove, the first terminal of a symmetrical structure has an insertion piece folded up by a piece of metal plate and inserted into the insertion hole, two free ends of the insertion piece are bent oppositely to form two connecting pieces located in the locating groove, two free ends of the two connecting pieces are bent upward to form two fastening pieces located in the locating groove, two opposite ends of the fastening piece extend outward, and then extend downward to form two bars inserted into the fillisters, the two bars are punched outward to form two resisting portions interfering with two opposite inner sides of the locating frame, two free ends of the fastening pieces are arced outward to form two clamping pieces projecting beyond the locating groove.

7. The lamp holder connector as claimed in claim 1, wherein the second holder has a base wall disposed horizontally, a first frame is located on a top of the base wall, a rear of the first frame defines a gap, two inner sides of two sidewalls of the gap extend forward to form two blocking arms, a clipping groove is formed among the blocking arm, the corresponding sidewall of the gap and a rear of a side of the first frame, a holding groove is formed among a front of the first frame and two fronts of the two sides of the first frame, each side of the first frame defines a second buckling hole, the second terminal of a symmetrical structure has a lying T-shaped base portion located in the holding groove, two opposite sides of the base portion bend upward to form two bending portions with two buckling blocks being punched outward, two fronts of the two bending portions are located in the holding groove with the buckling blocks buckled in the second buckling holes, two front ends of the two bending portions are bent towards each other, and then extend forward to form two elastic portions located in the holding groove, a rear end of the base portion is connected with a supporting board located behind the rear of the first frame.

8. The lamp holder connector as claimed in claim 2, wherein the bottom of the connecting part defines an insertion slot corresponding to the insertion hole of the base, the insertion piece of the first terminal passes through the insertion slot to insert into an interval between the two elastic portions of the second terminal.

9. The lamp holder connector as claimed in claim 6, wherein the bottom of the connecting part defines an insertion slot corresponding to the insertion hole of the base, the insertion piece of the first terminal passes through the insertion slot to insert into an interval between the two elastic portions of the second terminal.

10. The lamp holder connector as claimed in claim 7, wherein the bottom of the connecting part defines an insertion slot corresponding to the insertion hole of the base, the insertion piece of the first terminal passes through the insertion slot to insert into an interval between the two elastic portions of the second terminal.

* * * * *